US009332823B2

(12) United States Patent
Rattei

(10) Patent No.: US 9,332,823 B2
(45) Date of Patent: May 10, 2016

(54) SHOULDER HARNESS SYSTEM

(71) Applicant: Todd G. Rattei, Napoleon, ND (US)

(72) Inventor: Todd G. Rattei, Napoleon, ND (US)

( * ) Notice: Subject to any disclaimer, the term of this patent is extended or adjusted under 35 U.S.C. 154(b) by 0 days.

(21) Appl. No.: 14/275,058

(22) Filed: May 12, 2014

(65) Prior Publication Data

US 2015/0320186 A1 Nov. 12, 2015

(51) Int. Cl.
*A45F 3/14* (2006.01)

(52) U.S. Cl.
CPC ..... *A45F 3/14* (2013.01)

(58) Field of Classification Search
CPC ..... A63B 21/0724; A45F 3/14
USPC ..... 224/184; 280/1.5, 18
See application file for complete search history.

(56) References Cited

U.S. PATENT DOCUMENTS 3,679,107 A 7/1972 Perrine
3,724,846 A 4/1973 Perrine
4,706,858 A 11/1987 Whatley
4,863,158 A * 9/1989 Tassone ..... 482/140
5,009,349 A 4/1991 Eide et al.
5,580,342 A * 12/1996 Johnson ..... 482/105
5,957,818 A * 9/1999 Betournay ..... 482/105
6,006,968 A 12/1999 McCarthy et al.
6,257,633 B1 7/2001 Katz
9,005,087 B1 * 4/2015 Betoney, Jr. ..... 482/104

OTHER PUBLICATIONS www.competitiveedgeproducts.com/detail.aspx?ID=1658&utm_source=pricegrabber&utm_medium=cpc&utm_campaign=product; Power Systems Power Sled by Power Systems; Received Apr. 30, 2014.

www.clamoutdoors.com/ice_fishing/http-clamcorp-com-ice-fishing-shelter-acc/towing-sleds/sled-pulling-harness.html; Sled Pulling Harness by Clam Corporation; Received Apr. 30, 2014.

* cited by examiner

*Primary Examiner* — Corey Skurdal
(74) *Attorney, Agent, or Firm* — Neustel Law Offices; Michael S. Neustel

(57) ABSTRACT

A shoulder harness system for efficiently pulling objects by a human. The shoulder harness system generally includes a support member having a central segment formed to fit about the back of the neck, a first segment extending from the central segment, a second segment extending from the central segment opposite of the first segment, a first connecting end extending from the first segment and a second connecting end extending from the second segment. The central segment is formed to fit about the rear portion of the neck of the user and the first segment and the second segment are formed to be positioned adjacent to an upper front portion of the user's chest. The connecting ends include apertures that receive a corresponding fastener to secure a first connector and a second connector respectively to the first connecting end and the second connecting end. The connectors are attached to the object to be pulled.

18 Claims, 10 Drawing Sheets

SHOULDER HARNESS SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a pulling harness and more specifically it relates to a shoulder harness system for efficiently pulling objects by a human.

2. Description of the Related Art

Any discussion of the related art throughout the specification should in no way be considered as an admission that such related art is widely known or forms part of common general knowledge in the field.

Pulling harnesses for use by humans to pull an object (e.g. snow sleds, weight sleds, calf sleds, cargo sleds, rescue sleds, rescue carts, portable ice shelters, large game, carts, etc.) have been in use for years. Conventional harnesses are typically comprised of a pair of shoulder straps that the user inserts their arms through with a single connector on the back of the harness used to connect to the object to be pulled.

One of the main problems with conventional pulling harnesses is they are time consuming to connected and to remove. Another problem with conventional pulling harnesses is they do not allow you to back up the object being pulled. Another problem with conventional pulling harnesses is that they require the user to use their hands to remove the harness. Another problem with conventional pulling harnesses is that they require adjustment to by the user. Another problem with conventional pulling harnesses is that the fabric material used to construct the pulling harnesses can become wet and dirty during usage. Another problem with conventional pulling harnesses is that they distribute the pulling force over two relatively narrow vertical portions of the body which can lead to discomfort to the user. Another problem with conventional pulling harnesses made of fabric is that they are not able to efficiently carry weight.

Because of the inherent problems with the related art, there is a need for a new and improved shoulder harness system for efficiently pulling objects by a human.

BRIEF SUMMARY OF THE INVENTION

The invention generally relates to a pulling harness for pulling objects which includes a support member having a central segment formed to fit about the back of the neck, a first segment extending from the central segment, a second segment extending from the central segment opposite of the first segment, a first connecting end extending from the first segment and a second connecting end extending from the second segment. The central segment is formed to fit about the rear portion of the neck of the user and the first segment and the second segment are formed to be positioned adjacent to an upper front portion of the user's chest. The connecting ends include apertures that receive a corresponding fastener to secure a first connector and a second connector respectively to the first connecting end and the second connecting end. The connectors are attached to the object to be pulled.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1A:
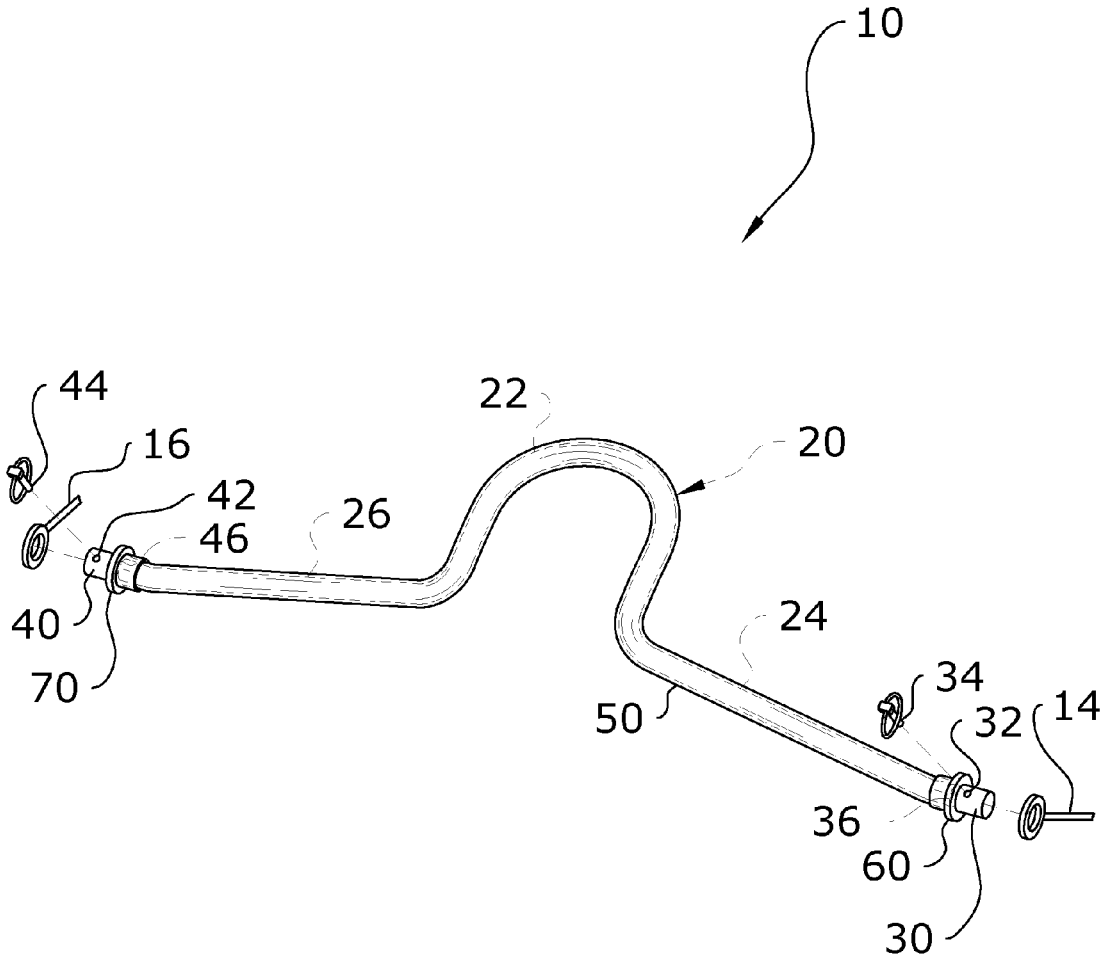
FIG. 1*a* is an upper perspective view of the present invention.

Turning now descriptively to the drawings, in which similar reference characters denote similar elements throughout the several views, FIGS. 1*a* through 10 illustrate a shoulder harness system 10, which comprises a support member 20 having a central segment 22 formed to fit about the back of the neck 18, a first segment 24 extending from the central segment 22, a second segment 26 extending from the central segment 22 opposite of the first segment 24, a first connecting end 30 extending from the first segment 24 and a second connecting end 40 extending from the second segment 26. The central segment 22 is formed to fit about the rear portion of the neck 18 of the user and the first segment 24 and the second segment 26 are formed to be positioned adjacent to an upper front portion of the user's chest. The connecting ends include apertures that receive a corresponding fastener to secure a first connector 14 and a second connector 16 respectively to the first connecting end 30 and the second connecting end 40. The connectors are attached to the object 12 to be pulled. The object 12 to be pulled may be comprised of various devices such as but not limited to sleds, carts, snow sleds, weight sleds, calve sleds, cargo sleds, rescue sleds, rescue carts, portable ice shelters, large game (e.g. deer) and the like. The present invention also is capable of carrying weight along with pulling the object 12 which is useful for pulling carts or carrying other types of objects 12.

FIGS. 1*a* through 4 best illustrate the support member 20. The support member 20 is an elongated structure that is formed to extend around the back of the neck 18 of the user and in front of the upper front portion of the chest. Various items may be attached to the support member 20 such as but not limited to flashlights, cameras, reflectors and the like. The support member 20 further extends outwardly from the opposing shoulders 19 of the user thereby allowing the opposing distal ends of the support member 20 to be removably connected to a first connector 14 and a second connector 16 that are connected to an object 12.

The first connector 14 and the second connector 16 are preferably comprised of a rigid elongated structure (e.g. poles) thereby allowing the user to both forwardly pull and rearwardly push the object 12 along with controlling the longitudinal direction of the object 12. The first connector 14 and the second connector 16 may also be comprised of non-rigid elongated structures such as but not limited to ropes, chains and straps.

The support member 20 is preferably comprised of a unitary structure and is further preferably comprised of a rigid material. The support member 20 is further preferably constructed of a metal material such as but not limited to steel, aluminum and the like. The support member 20 is further preferably comprised of a metal rod having a solid, non-tubular cross section.

Figure 1B:
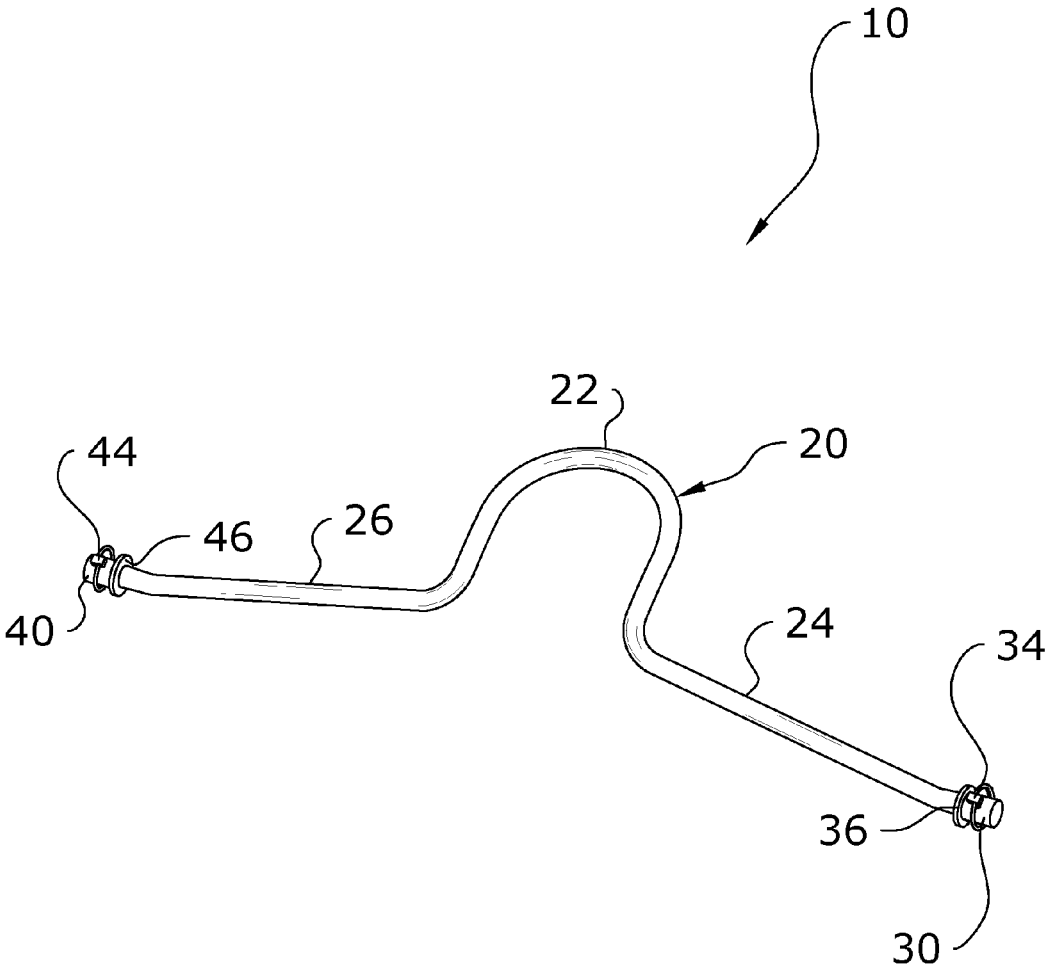
FIG. 1*b* is an upper perspective view of the present invention without a covering over the support member.
Figure 2:
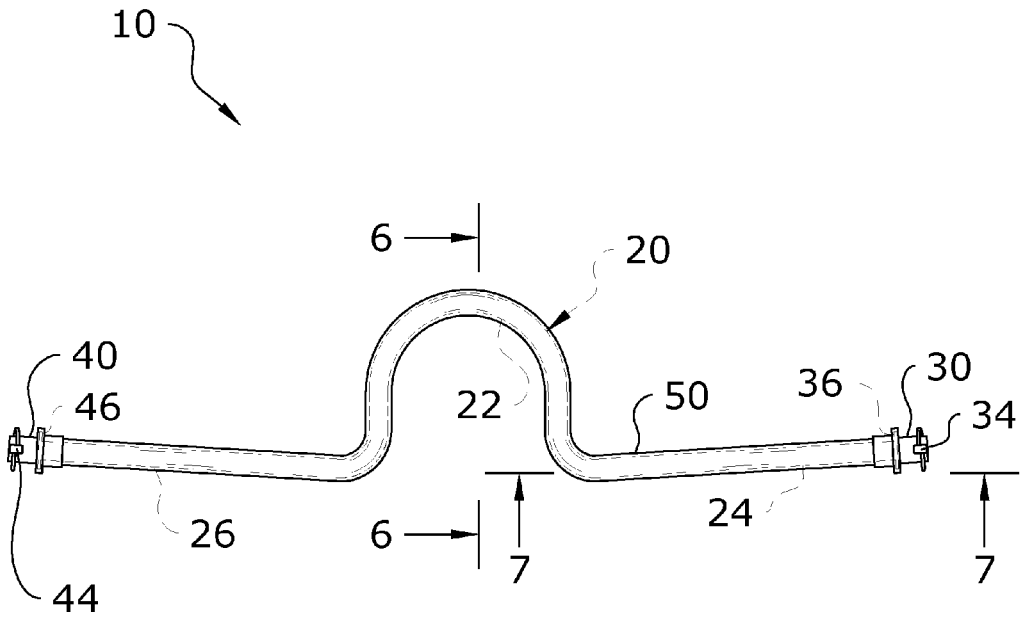
FIG. 2 is a top view of the present invention.
Figure 3:
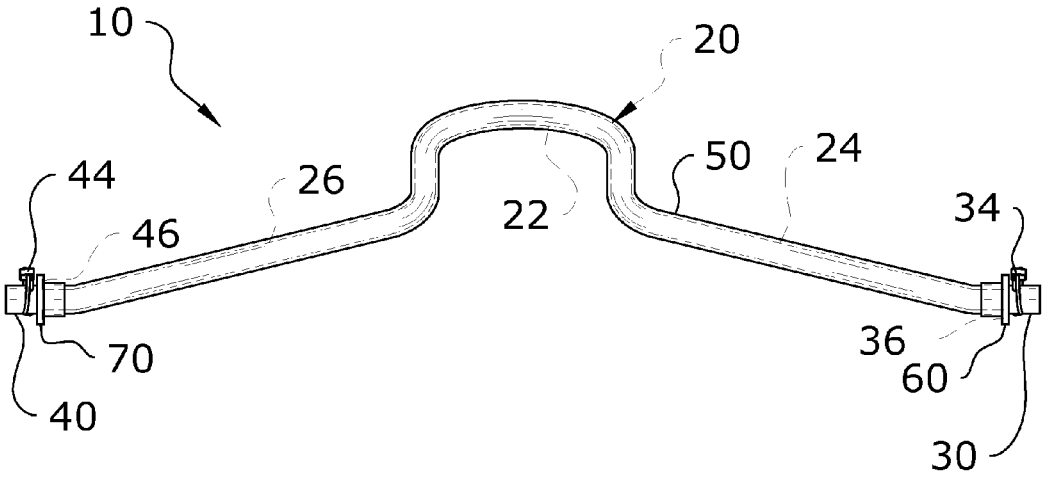
FIG. 3 is a front view of the present invention.
Figure 4:
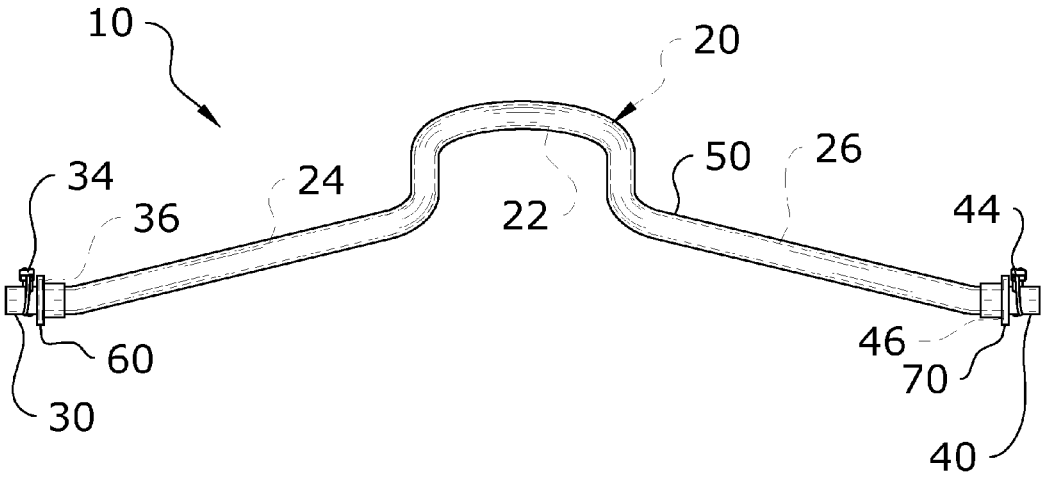
FIG. 4 is a rear view of the present invention.

The support member 20 has a central segment 22, a first segment 24 and a second segment 26 as best illustrated in FIG. 1*b* of the drawings. The first segment 24 and the second segment 26 extend outwardly from opposing front ends of the central segment 22 wherein the first segment 24 extends outwardly away from the second segment 26. As illustrated in FIG. 2 of the drawings, the central segment 22 is between the first segment 24 and the second segment 26 with a front opening formed between the first segment 24 and the second segment 26 allowing the support member 20 to be positioned over the back of the neck 18.

The central segment 22 is formed to be removably positioned about a rear portion of a neck 18 of a user. The central segment 22 is further ergonomically shaped to comfortably rest upon the lower rear portion of the neck 18 of the user in a comfortable manner.

Figure 5:
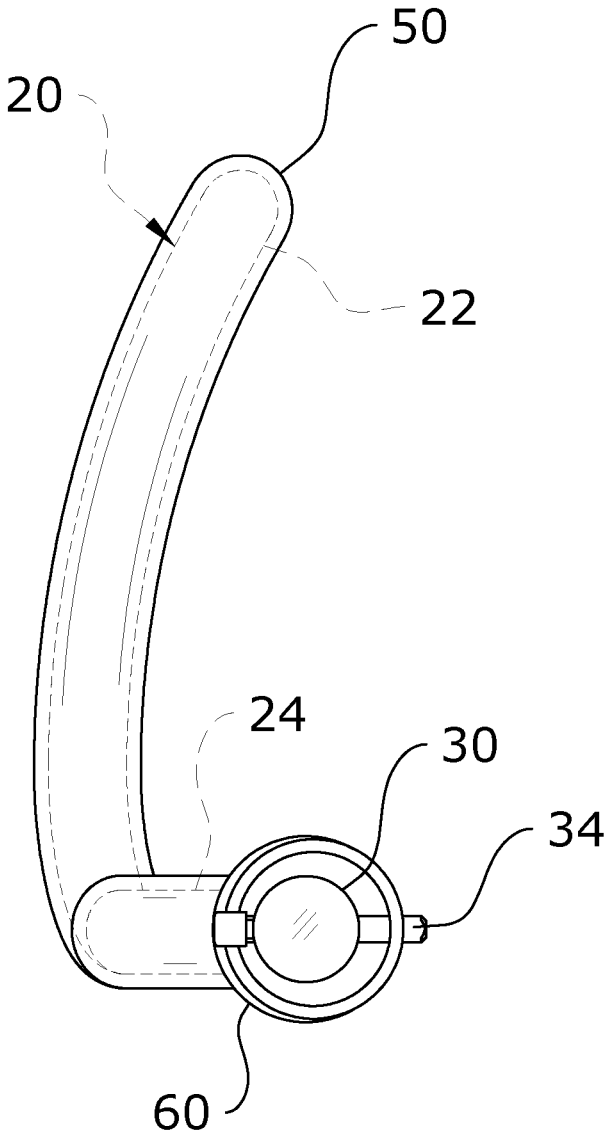
FIG. 5 is a side view of the present invention.
Figure 6:
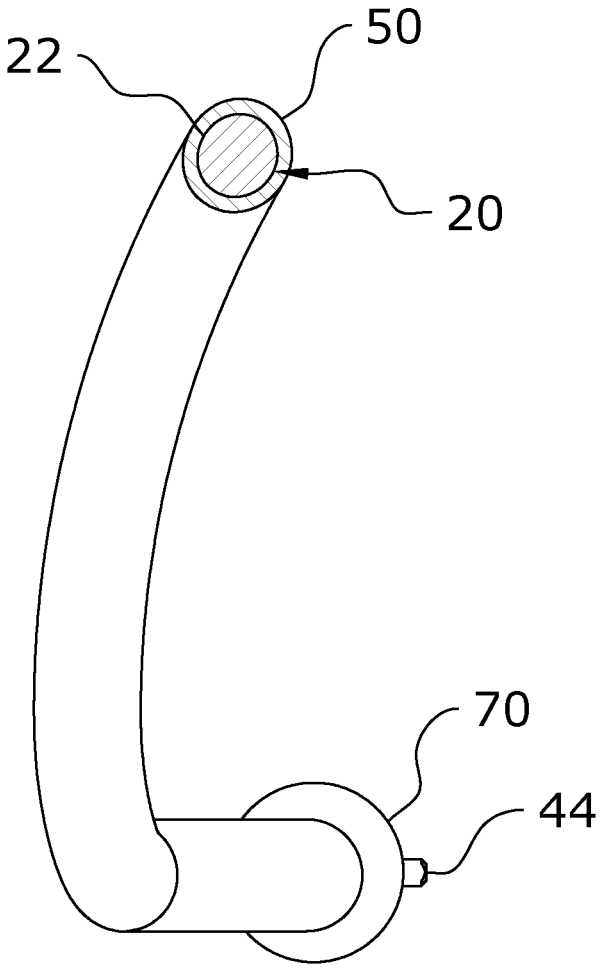
FIG. 6 is a cross sectional view taken along line 6-6 of FIG. 2.
Figure 7:
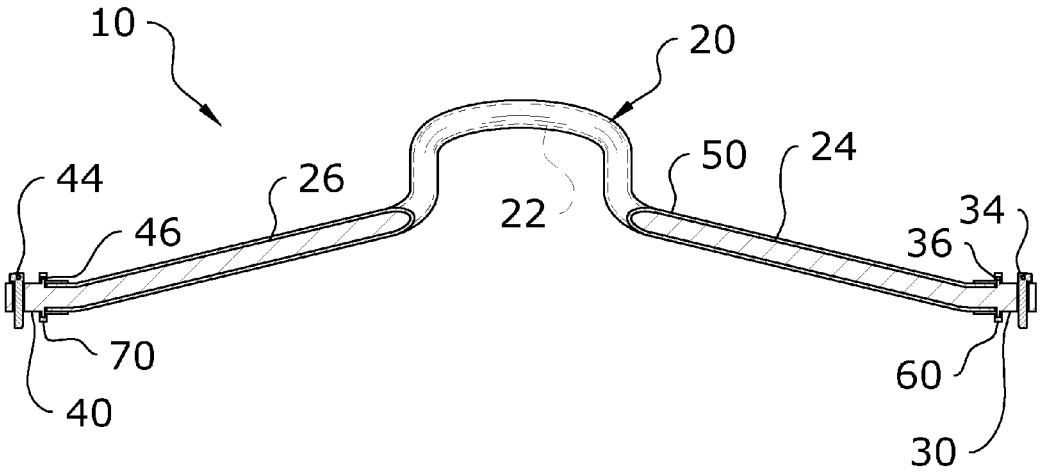
FIG. 7 is a cross sectional view taken along line 7-7 of FIG. 2.
Figure 9:
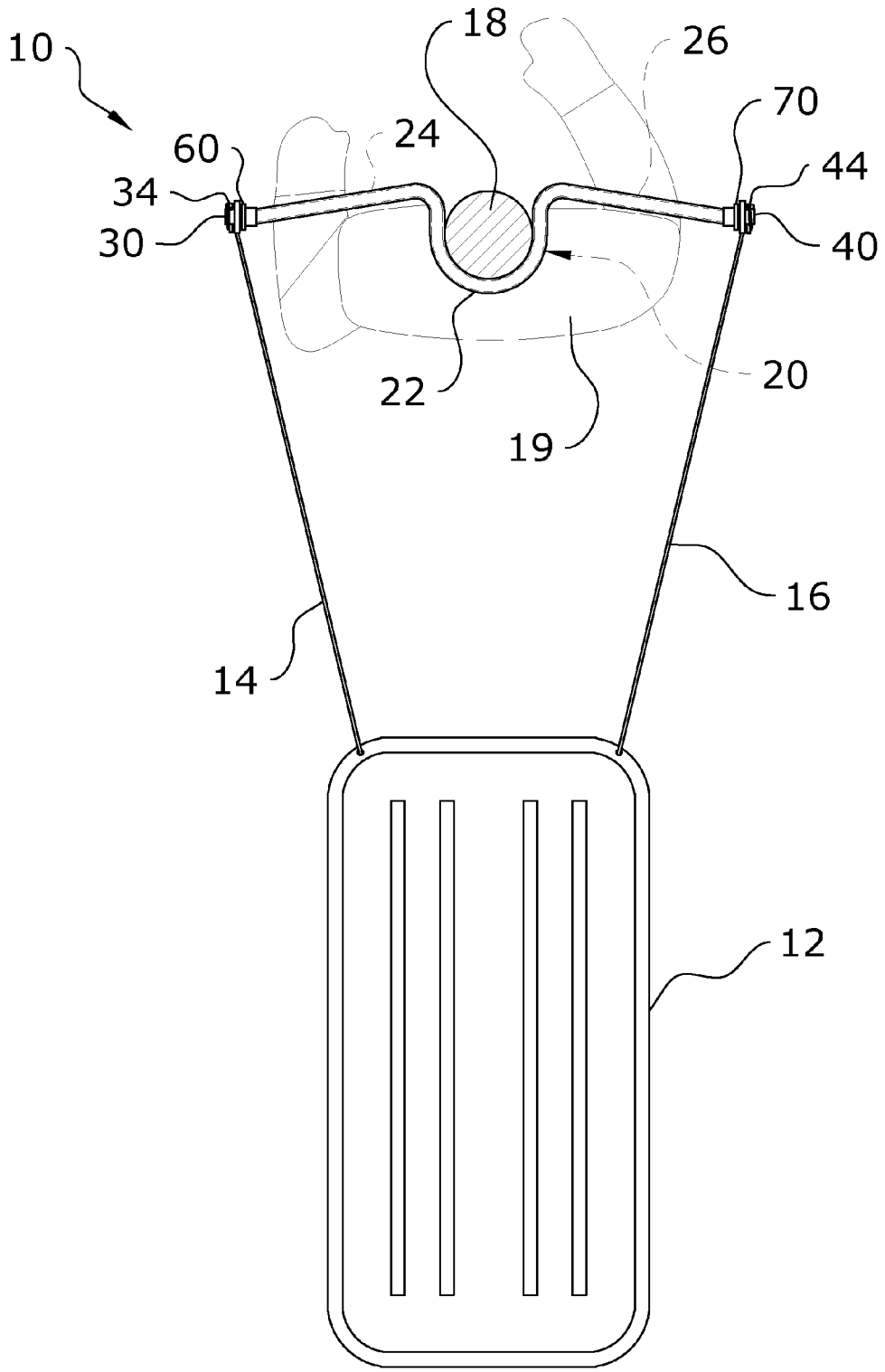
FIG. 9 is a top view of the present invention positioned upon a user pulling an object.
Figure 10:
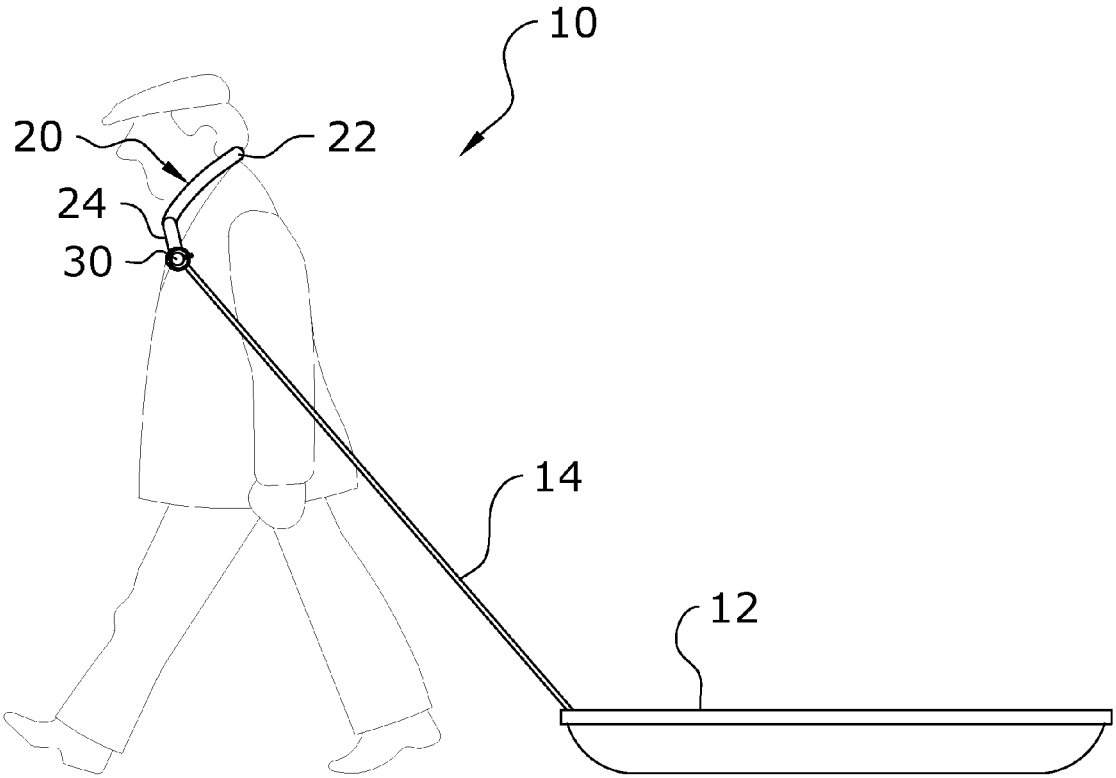
FIG. 10 is a side view of the present invention positioned upon a user pulling an object.

The central segment 22 is comprised of a curved structure. As best illustrated in FIGS. 1*b*, 2 and 9 of the drawings, the central segment 22 is comprised of a U-shaped structure, wherein a curved closed end portion of the central segment 22 extends rearwardly and is positionable adjacent to the rear portion of the neck 18 of the user. As illustrated in FIGS. 5 and 10 of the drawings, the central segment 22 extends forwardly from the closed end portion and is downwardly curved from the closed end portion to the front open end thereby allowing the first segment 24 and the second segment 26 to extend outwardly to the sides of the user along an upper front portion of the chest of the user.

Figure 8:
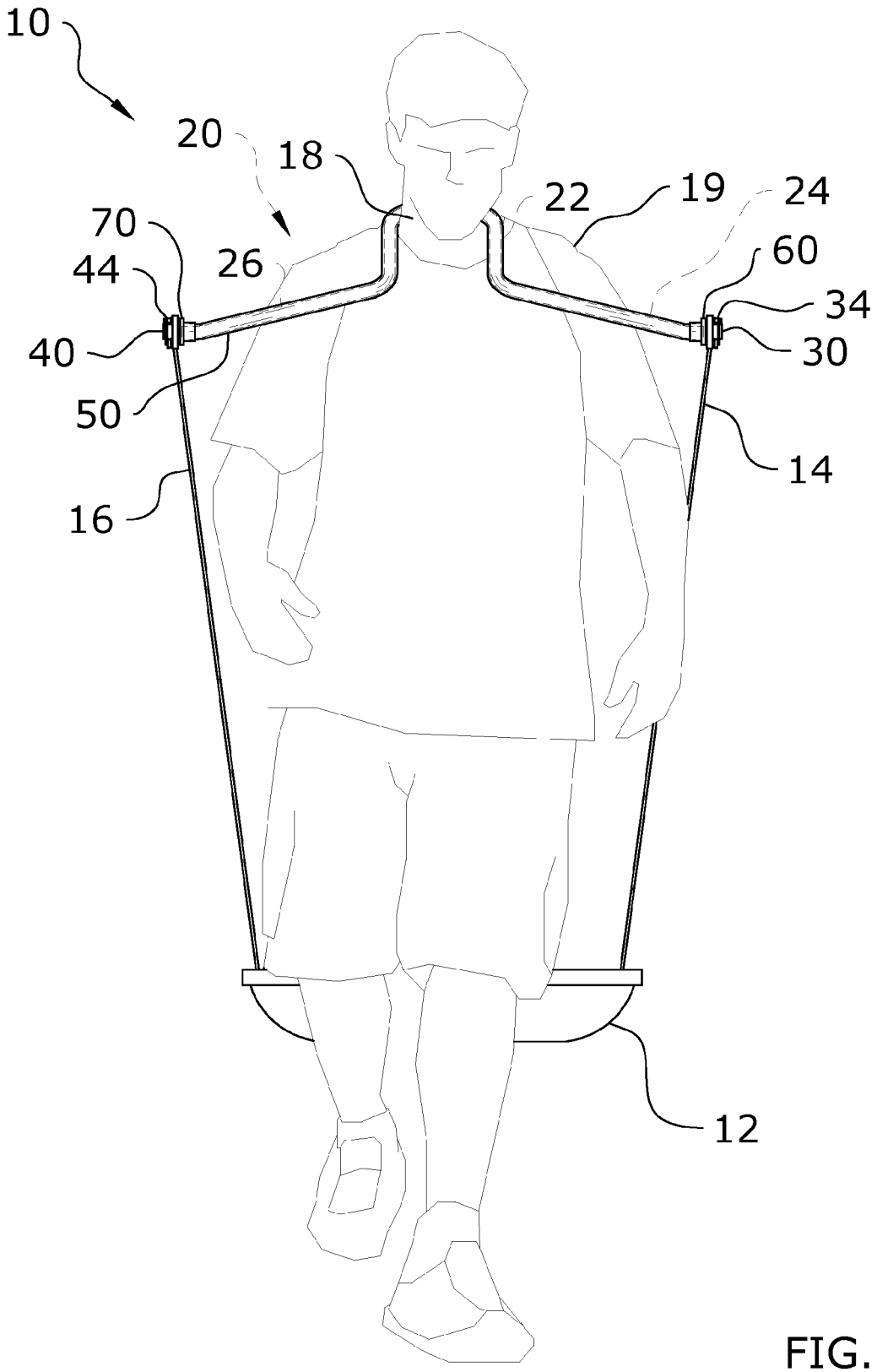
FIG. 8 is a front view of the present invention positioned upon a user pulling an object.

As best illustrated in FIG. 8 of the drawings, the first segment 24 is formed to be positioned adjacent to a first portion of an upper front portion of a chest of the user and the second segment 26 is formed to be positioned adjacent to a second portion of the upper front portion of the chest of the user. The first portion of the upper front portion of the chest is opposite of the second portion thereof.

The first segment 24 preferably mirrors the second segment 26 to provide increased symmetry, balance weight and ergonomics for the user. The first segment 24 and the second segment 26 preferably extend outwardly, downwardly and rearwardly from the forward ends of the central segment 22 as illustrated in FIGS. 1 through 4 of the drawings. This design for the support member 20 ensures that a significant portion of the support member 20 and particularly the side segments 24, 26 are positioned adjacent to the upper front portion of the chest and the upper front portion of the shoulders 19 to distribute the force along the body of the user.

A first connecting end 30 extends outwardly from the first segment 24 and a second connecting end 40 extends outwardly from the second segment 26. The first connecting end 30 and the second connecting end 40 are preferably comprised of the unitary structure of the support member 20.

The first connecting end 30 includes a first aperture 32 for removably receiving a first fastener 34 to secure the first connector 14 to the first connecting end 30 and the second connecting end 40 includes a second aperture 42 for removably receiving a second fastener 44 to secure the second connector 16 to the second connecting end 40. The fasteners are preferably comprised of a fastener that is easy to insert, secure and remove such as a linchpin as illustrated in FIGS. 1*a* through 5 of the drawings. The first connecting end 30 preferably includes a first flange 36 positioned inwardly from the first aperture 32 and the second connecting end 40 preferably includes a second flange 46 positioned inwardly from the second aperture 42 to prevent the first connector 14 and the second connector 16 from extending inwardly along the support member 20.

It is preferable to have a support cover 50 surrounding the support member 20 to insulate the user from the cold and to prevent rusting of the support member 20. The support cover 50 preferably surrounds at least the central segment 22 of the support member 20 which surrounds a rear and side portions of the neck 18 of the user. The support cover 50 further preferably surrounds at least a portion of the first segment 24 and the second segment 26. It is preferred that the support cover 50 surround at least said central segment 22, said first segment 24 and said second segment 26. It is further preferably that a first end cover 60 surrounds the first flange 36 and overlaps a portion of the support cover 50 along with a second end cover 70 that surrounds the second flange 46 and overlaps a portion of the support cover 50 opposite of the first end cover 60 as illustrated in FIGS. 1*a* through 4 of the drawings. The support cover 50 and the end covers 60, 70 are preferably comprised of a non-permeable material that provides thermal insulation such as but not limited to rubber or plastic.

In use, the user connects the first connector 14 and the second connector 16 to the first connecting end 30 and the second connecting end 40 of the support member 20 respectively with the first fastener 34 and the second fastener 44. The first connector 14 and the second connector 16 are further attached to the object 12 to be pulled such as a sled as illustrated in FIGS. 8 through 10 of the drawings. Once the connectors 14, 16 are properly connected to the support member 20 and to the object 12 being pulled, the user positions the support member 20 upon the back of their neck 18 with the first segment 24 and second segment 26 positioned in front of their chest as shown in FIG. 8 of the drawings. The user is able to move forwardly thereby pulling the object 12 with the force from the object 12 being evenly distributed along the length of the first segment 24 and the second segment 26 of the support member 20. If the user desires to move the object 12 rearwardly, they simply walk backwards forcing the object 12 rearwardly. If the user needs to quickly remove the support member 20, the user simply lifts their arms upwardly forcing the first segment 24 and the second segment 26 over the top of the shoulders 19 and moves forwardly allowing the support member 20 to freely fall to the ground surface.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A shoulder harness for use by a human to pull an object, comprising:

a support member having a central segment, a first segment and a second segment;

wherein said central segment is between said first segment and said second segment;

wherein said central segment is formed to be removably positioned about a rear portion of a neck of a user;

wherein said first segment is formed to be positioned adjacent to a first portion of an upper front portion of a chest of said user;

wherein said second segment is formed to be positioned adjacent to a second portion of said upper front portion of said chest of said user;

wherein said first segment and said second segment extend outwardly and rearwardly from said central segment;

wherein said first segment and said second segment extend downwardly from said central segment;

a first connecting end extending from said first segment;

a second connecting end extending from said second segment; and wherein said first connecting end includes a first aperture for removably receiving a first fastener to secure a first connector to said first connecting end and wherein said second connecting end includes a second aperture for removably receiving a second fastener to secure a second connector to said second connecting end.

2. The shoulder harness of claim 1, wherein said support member is comprised of a unitary structure.

3. The shoulder harness of claim 1, wherein said support member is comprised of a rigid material.

4. The shoulder harness of claim 3, wherein said support member is comprised of a metal material.

5. The shoulder harness of claim 4, wherein said support member is comprised of a metal rod.

6. The shoulder harness of claim 1, wherein said central segment is comprised of a curved structure.

7. The shoulder harness of claim 1, wherein said central segment is comprised of a U-shaped structure.

8. The shoulder harness of claim 1, wherein said first segment extends outwardly away from said second segment.

9. The shoulder harness of claim 1, wherein said first segment mirrors said second segment.

10. The shoulder harness of claim 1, wherein said first fastener and said second fastener are each comprised of a linchpin.

11. The shoulder harness of claim 1, wherein said first connecting end includes a first flange positioned inwardly from said first aperture and wherein said second connecting end includes a second flange positioned inwardly from said second aperture.

12. The shoulder harness of claim 11, including a support cover that surrounds at least said central segment of said support member.

13. The shoulder harness of claim 1, wherein said first segment and said second segment are each substantially straight.

14. The shoulder harness of claim 1, wherein said central segment is comprised of a U-shaped structure, wherein a curved closed end portion of said central segment extends rearwardly behind a neck of said user, wherein said central segment is formed to be removably positioned about a rear portion of said neck of said user, wherein said central segment includes a pair of side members extending from said curved closed end portion, wherein said pair of side members each extend downwardly and forwardly to extend in front of said upper front portion of said chest of said user.

15. The shoulder harness of claim 14, wherein said first segment and said second segment extend from distal portions of said central segment positioned in front of said upper front portion of said chest of said user.

16. The shoulder harness of claim 1, wherein a significant portion of said first segment and said second segment are positioned adjacent to said upper front portion of said chest to distribute a pulling force along a body of said user.

17. A shoulder harness for use by a human to pull an object, comprising:

a support member having a central segment, a first segment and a second segment;

wherein said central segment is between said first segment and said second segment;

wherein said central segment is formed to be removably positioned about a rear portion of a neck of a user;

wherein said first segment is formed to be positioned adjacent to a first portion of an upper front portion of a chest of said user;

wherein said second segment is formed to be positioned adjacent to a second portion of said upper front portion of said chest of said user;

a first connecting end extending from said first segment;

a second connecting end extending from said second segment;

wherein said first connecting end includes a first aperture for removably receiving a first fastener to secure a first connector to said first connecting end and wherein said second connecting end includes a second aperture for removably receiving a second fastener to secure a second connector to said second connecting end;

wherein said first connecting end includes a first flange positioned inwardly from said first aperture and wherein said second connecting end includes a second flange positioned inwardly from said second aperture;

a support cover that surrounds at least said central segment of said support member, wherein said support cover surrounds said central segment, said first segment and said second segment; and a first end cover that surrounds said first flange and overlaps a portion of said support cover and a second end cover that surrounds said second flange and overlaps a portion of said support cover opposite of said first end cover.

18. A shoulder harness for use by a human to pull an object, comprising:

a support member having a central segment, a first segment and a second segment;

wherein said central segment is between said first segment and said second segment;

wherein said central segment is formed to be removably positioned about a rear portion of a neck of a user;

wherein said first segment is formed to be positioned adjacent to a first portion of an upper front portion of a chest of said user;

wherein said second segment is formed to be positioned adjacent to a second portion of said upper front portion of said chest of said user;

wherein said first segment and said second segment extend outwardly and rearwardly from said central segment;

wherein said first segment and said second segment extend downwardly from said central segment;

a first connecting end extending from said first segment;

a second connecting end extending from said second segment; and wherein said first connecting end includes a first flange positioned inwardly from a first fastener that is removably connected to said first connecting end and wherein said second connecting end includes a second flange positioned inwardly from a second fastener that is removably connected to said second connecting end.

* * * * *